United States Patent [19]

Van Thillo et al.

[11] Patent Number: 4,990,434

[45] Date of Patent: Feb. 5, 1991

[54] SUBBED POLYESTER FILM SUPPORT CARRYING CARBON BLACK ANTIHALATION LAYER

[75] Inventors: Etienne A. Van Thillo, Essen; Jan J. Priem, Mortsel, both of Belgium

[73] Assignee: AGFA-Gevaert, N.V., Mortsel, Belgium

[21] Appl. No.: 412,489

[22] Filed: Sep. 26, 1989

[30] Foreign Application Priority Data

Sep. 27, 1988 [EP] European Pat. Off. ..... 88202093.6

[51] Int. Cl.[5] ..... G03C 1/815

[52] U.S. Cl. ..... 430/510; 430/517; 430/523; 430/536

[58] Field of Search ..... 430/510, 517, 523, 536, 430/527

[56] References Cited

U.S. PATENT DOCUMENTS 4,914,011 4/1990 Grous ..... 430/536

4,914,018 4/1990 Besio ..... 430/536

*Primary Examiner*—Jack P. Brammer

*Attorney, Agent, or Firm*—A. W. Breiner

[57] ABSTRACT

The present invention provides a photographic element comprising a dimensionally stable hydrophobic transparent polyester film support, at least one light-sensitive silver halide emulsion layer, and at the side of said support opposite to that of said emulsion layer(s), a subbing layer essentially consisting of poly-N-vinyl pyrrolidone, and an antihalation layer comprising carbon black dispersed in a water-insoluble alkali-soluble copolymer of 1 to 65% by weight of a $C_1$–$C_4$ alkyl methacrylate, 10 to 79% by weight of a $C_1$–$C_8$ alkyl acrylate, and 10 to 50% by weight of acrylic acid or methacrylic acid. The present invention also provides a process of manufacturing a dimensionally stable hydrophobic transparent polyester film support carrying a subbing layer and an alkali-soluble carbon black antihalation layer, said process comprising monoaxially stretching an extruded amorphous polyester film, coating it with an aqueous solution of poly-N-vinyl pyrrolidone to form said subbing layer, drying it, stretching it together with said film in a direction perpendicular to that of the first stretching, heat-setting, coating the film support with an aqueous dispersion of carbon black in said above-mentioned water-insoluble alkali-soluble copolymer to form said alkali-soluble antihalation layer.

7 Claims, No Drawings

SUBBED POLYESTER FILM SUPPORT CARRYING CARBON BLACK ANTIHALATION LAYER

DESCRIPTION

The present invention relates to photographic elements comprising an alkali-soluble carbon black antihalation layer on a subbed hydrophobic transparent polyester film support and to a process of manufacturing a dimensionally stable hydrophobic transparent polyester film support carrying a subbing layer and an alkali-soluble carbon black antihalation layer, said subbing layer being adapted to improve the adhesion of said antihalation layer to said subbed film support and at the same time to improve the removability in alkaline solution of said antihalation layer from said subbed film support.

The problem of reducing halation in photographic elements and in particular in photographic elements comprising a polyester film support is well known. Halation arises as a consequence of the reflection of light by the polyester film support toward the light-sensitive layer or layers. This reflection of light is usually neutralized by applying to the side of the polyester film support opposite to that carrying the emulsion layer or layers, a light-absorbing layer, which currently is called antihalation layer. Such antihalation layer may consist of a dye or pigment dispersed in a natural or synthetic binder. Very often carbon black is used in dispersed form in a binder. A carbon black antihalation layer provides excellent halation protection and has excellent antistatic properties.

Usually, a carbon black antihalation layer is applied to the side of the polyester film support that is opposite to that carrying the light-sensitive layer or layers. It is composed of carbon black dispersed in a water-insoluble alkali-soluble binder and is to be removed from the polyester film support in an alkaline processing bath. Normally, the alkali-soluble carbon black antihalation layer is removed from the polyester film support according to a procedure involving the three following consecutive steps: first allowing the layer to swell in an alkaline solution, secondly spraying the swollen layer vigorously with water to remove it as much as possible from the polyester film support, and finally mechanically removing the remaining parts of the layer with rubbing means e.g. rotating brushes. According to this procedure the removal should be easy and complete.

However, prior to its removal in an alkaline solution, the antihalation layer should strongly adhere to the polyester film support.

These characteristics of strong adherence to the polyester film support and of easy removability therefrom in alkaline solution are difficult to combine in an antihalation layer.

Many attempts have been made to improve the adhesion of antihalation layers to hydrophobic polyester film supports.

According to one way of approaching the problem of adhesion of antihalation layers to a polyester film support it was tried to optimalize the nature or composition of the binder of the antihalation layer. It is known e.g. from FR-A No. 2,078,630 to improve the adhesion to a polyethylene terephthalate film support by providing a water-insoluble alkali-soluble copolymer binder for the antihalation layer, which copolymer consists of 20 to 50% by weight of (meth)acrylic acid, 15 to 79% by weight of a $C_1$–$C_8$ alkyl acrylate, and 1 to 50% by weight of a $C_1$–$C_4$ alkyl methacrylate. However, the adhesion of an antihalation layer of this type was still unsatisfactory and in spite of this insufficient adhesion mechanical means were needed to remove the antihalation layer completely from the hydrophobic polyester film support. The risk for incomplete removal of the antihalation layer was substantial.

According to an alternative way of approaching the problem of adhesion of an antihalation layer to a polyester film support one or more intermediate or subbing layers are provided between the hydrophobic film support and the antihalation layer.

For instance, in FR-A No. 1,582,378 a subbing layer comprising a copolymer of at least one of the chlorine-containing monomers vinylidene chloride and vinyl chloride has been described for this purpose.

In U.S. Pat. No. 3,677,790 a film support with removable opaque coatings has been described, which in the given order comprises an optional but preferred gelatin pelloid layer, a barrier layer of a water-soluble polymer, which should be compatible with gelatin to form a good bond with the gelatin pelloid layer and an opaque layer of carbon black in a water-insoluble polymer binder e.g. a copolymer of ethyl acrylate and acrylic acid. As mentioned in the document tests revealed that the use of poly-N-vinyl pyrrolidone as polymer for the barrier layer gave poor results for wet stripping.

It is also known from U.S. Pat. No. 4,132,552 to add up to 5% by weight of a hydrophilic polymer e.g. poly-N-vinyl pyrrolidone to the composition for coating a subbing layer on a polyester film support, said composition comprising a mixture of (A) 52–79% by weight of copolymeric binder comprising 60–95% by weight of methyl methacrylate, 0–30% by weight of a plasticizing monomer, 3–20% by weight of a divinyl or diallyl monomer, and 0–5% by weight of an unsaturated carboxylic acid, and (B) 0.5–3% by weight of a water-insoluble wax-like material, and (C) 20–40% by weight of an external plasticizer.

Yet, as soon as an adequate adhesion could be realized indeed, the removability of the antihalation layer in an alkaline solution often became a problem. Considerable mechanical means had to be used for a considerable time to remove the layer, sometimes even with quite unsatisfactory results.

It was therefore tried to facilitate the removal of antihalation layers from their polyester film support by providing an intermediate or subbing layer having a special composition between the hydrophobic polyester film support and the antihalation layer. For instance, according to U.S. Pat. No. 3,846,134 an antihalation layer is carried by a hydrophobic transparent film support coated with an intermediate layer comprising a mixture of 1 to 3 parts by weight of a cellulose ester and 3 to 1 parts by weight of at least one alkali-soluble polymer e.g. sulphonated polystyrene, (nitrated) co(styrene/maleic acid, co(vinyl acetate/maleic acid) (50:50 mol %), co(vinyl acetate/crotonic acid) (94:6 mol %), co(styrene/acrylic acid) (70:30 mol %), and co(styrene/methacrylic acid) (30:70 mol %), the binder of the antihalation layer being a water-insoluble alkali-soluble polymer e.g. co(styrene/acrylic acid) (70:30% by weight), co(methyl acrylate/acrylic acid) (80:20% by weight), and co(ethyl acrylate/methyl methacrylate/methacrylic acid) (35:35:30% by weight).

However, one of the major difficulties encountered with respect to such layer composition is the cloudiness of the resulting intermediate layer and/or antihalation layer.

Consequently, there still remains a need to find a proper balance between good adhesion and easy removal of the antihalation layer while at the same time avoiding coating problems.

For completeness' sake reference is also made to GB-A No. 815,662, according to which the adhesion of an antistatic layer comprising polystyrene sulphonate to a cellulose triacetate support is improved by providing a substratum of poly-N-vinyl pyrrolidone between said antistatic layer and said cellulose triacetate support. However, the technology and chemistry applied for improving the adhesion of an antistatic layer that is to remain permanently on a support of cellulose triacetate, differ greatly from those applied for improving the adhesion of non-permanent alkali-labile antihalation layers to polyester film supports. A prime difference is for instance that a cellulose triacetate film support is not stretched, whereas polyester film support requires special stretching procedures.

It is an object of the present invention to provide a photographic element, in which the antihalation layer strongly adheres to the subbed hydrophobic transparent polyester film support and can nevertheless be removed easily therefrom in an alkaline solution.

It is also an object of the present invention to provide a method of improving the adhesion of an antihalation layer to a hydrophobic transparent polyester film support of a photographic element and at the same time improving the removability of said antihalation layer from said polyester film support by treatment with an alkaline solution.

According to the present invention there is provided a photographic element comprising a dimensionally stable hydrophobic transparent biaxially stretched polyester film support, at least one light-sensitive silver halide emulsion layer, and at the side of said support opposite to that of said light-sensitive silver halide emulsion layer or layers, in the order given:

a layer of a water-soluble polymer binder essentially consisting of poly-N-vinyl pyrrolidone, and an antihalation layer comprising carbon black dispersed in a water-insoluble alkali-soluble copolymer binder essentially consisting of a copolymer of 1 to 65% by weight of a $C_1$–$C_4$ alkyl methacrylate, 10 to 79% by weight of a $C_1$–$C_8$ alkyl acrylate, and 10 to 50% by weight of acrylic acid and/or methacrylic acid.

According to the present invention there is also provided a process of manufacturing a dimensionally stable hydrophobic transparent polyester film support carrying a subbing layer and an alkali-soluble carbon black antihalation layer, said subbing layer being adapted to provide a strong adhesion of said antihalation layer to said subbed polyester film support and at the same time to provide an easy removability of said antihalation layer from said subbed polyester film support by spraying with water upon treatment in an alkaline solution, said process comprising the consecutive steps of monoaxially stretching, preferably longitudinally, an extruded amorphous polyester film, coating the side thereof that is to carry said antihalation layer with an aqueous solution comprising a water-soluble polymer binder to form said subbing layer, said water-soluble polymer binder of said subbing layer essentially consisting of poly-N-vinyl pyrrolidone, drying said subbing layer, stretching the resulting subbing layer together with said monoaxially stretched polyester film in a direction perpendicular to that of the first stretching operation, preferably transversely, heat-setting the stretched subbed polyester film, coating the resulting polyester film support on its subbed side with an aqueous dispersion of carbon black in a water-insoluble alkali-soluble copolymer binder to form said alkali-soluble antihalation layer, said water-insoluble alkali-soluble copolymer binder of said antihalation layer essentially consisting of a copolymer of 1 to 65% by weight of a $C_1$–$C_4$ alkyl methacrylate, 10 to 79% by weight of a $C_1$–$C_8$ alkyl acrylate, and 10 to 50% by weight of acrylic acid or methacrylic acid.

By "strong adhesion" of the alkali-soluble antihalation layer to the hydrophobic transparent polyester film support, as achieved in accordance with the present invention by means of said subbing layer, is meant herein that when a pressure-sensitive adhesive tape is pressed onto the dry antihalation layer and then torn off at an acute angle, the antihalation layer should be left undamaged.

By "easy removability" of the antihalation layer from the hydrophobic transparent polyester film support, as achieved in accordance with the present invention through the intermediary of said subbing layer applied between said antihalation layer and said support, is meant herein that when the antihalation layer is allowed to swell in an alkaline solution and then sprayed vigorously with water, it will loosen for the greater part from the polyester film support, and that when any remaining pieces of the layer are subjected to the action of rubbing means e.g. rotating brushes, these remaining parts will detach completely and quickly.

It has been established surprisingly that by providing a subbing layer essentially consisting of poly-N-vinyl pyrrolidone between a hydrophobic transparent polyester film support and an antihalation layer comprising carbon black dispersed in a water-insoluble alkali-soluble copolymer binder essentially consisting of a copolymer of 1 to 65% by weight of a $C_1$–$C_4$ alkyl methacrylate, 10 to 79% by weight of a $C_1$–$C_8$ alkyl acrylate, and 10 to 50% by weight of acrylic acid or methacrylic acid, a strong adhesion before treatment in the processing baths is achieved and that said antihalation layer does not start loosening from said polyester film support during treatment in the alkaline solution, but detaches almost entirely during the subsequent spraying with water, and needs but little or no brushing at all to remove any remaining pieces from said polyester film support. It has also been found concomitantly that this strong adhesion and easy removability are achieved thanks to the special compositions of the subbing layer and the antihalation layer, but subject to the condition that the subbing layer is coated between the first and the second stretching operations. It has been experienced indeed that the same strong adhesion and easy removability could not be attained when the subbing layer was coated after the second stretching operation.

The poly-N-vinyl pyrrolidone binder for use in the subbing layer according to the present invention may have a molecular weight ranging from approximately 10,000 to approximately 700,000, preferably from approximately 40,000 to 700,000.

Poly-N-vinyl pyrrolidones that can be used in accordance with the present invention are e.g. the following commercially available products:

PVP K-15 (trade mark) sold by GAF CORP., 140W. 51st St., New York, N.Y. 10020, U.S.A.; molecular weight of approximately 10,000;

LUVISKOL K-30 (trade mark) sold by BASF AG, D-6700 Ludwigshafen/Rhein, Federal Republic of Germany; molecular weight of approximately 40,000;
PVP K-60 (trade mark) sold by GAF CORP.; molecular weight of approximately 160,000; and
LUVISKOL K-90 (trade mark) sold by BASF AG; molecular weight of approximately 700,000.

Solvents that can be used for dissolving the poly-N-vinyl pyrrolidone are water or mixtures of water and a lower alcohol e.g. methanol, ethanol, and isopropanol. Preferably, the solvent is a mixture of water and isopropanol in a ratio by volume of 90:10.

The dry stretched subbing layer may comprise 3 to 550 mg of poly-N-vinyl pyrrolidone per m2, preferably 10 to 250 mg per m2. It may also comprise 0.05 to 10 mg of surfactant per m2.

Although a weight of the dry stretched subbing layer of more than 550 mg per m2 would still be acceptable insofar as removability of the antihalation layer in alkaline medium is concerned, it is found to be less acceptable because of the fact that the adhesion of the antihalation layer to the polyester film support is impaired.

The aqueous solution for coating the subbing layer may also comprise additional ingredients such as surfactants, plasticizers, and antifrothing agents. Suitable surfactants are e.g. the following:
2-(N,N-dimethyl-N-n-hexadecyl-ammonium)-acetic acid betain (85% aqueous solution);
GAFAC RM-710 (trade mark) of a polyethoxylated phosphate ester commercially available from GAF Corporation, 140 West 51st Street, New York, N.Y. 10020, U.S.A.; and
polyethoxylated carboxylic acid.

The water-insoluble alkali-soluble copolymer binder of the antihalation layer can be added as such in dry condition to the coating composition of said layer. Preferably, however, it is added thereto in the form of an aqueous dispersion or latex.

Suitable representatives of water-insoluble alkali-soluble copolymers that can be used as copolymer binder for the antihalation layer according to the present invention are i.a.:

| | |
|---|---|
| co(methyl methacrylate/ethyl acrylate/ methacrylic acid) | (50/33.5/16.5) |
| co(methyl methacrylate/ethyl acrylate/ methacrylic acid) | (37/37/26) |
| co(methyl methacrylate/methyl acrylate/acrylic acid) | (1/79/20) |
| co(methyl methacrylate/n-butyl acrylate/ methacrylic acid) | (30/35/35) |
| co(methyl methacrylate/n-butyl acrylate/ methacrylic acid) | (2/68/30) |
| co(methyl methacrylate/isobutyl acrylate/acrylic acid) | (50/33.5/16.5) |
| co(methyl methacrylate/2-ethylhexyl acrylate/ methacrylic acid) | (30/30/40) |
| co(ethyl methacrylate/n-butyl acrylate/ methacrylic acid) | (3/67/30) |
| co(n-butyl methacrylate/ethyl acrylate/ methacrylic acid) | (2/78/20) |
| co(isobutyl methacrylate/n-butyl acrylate/acrylic acid) | (30/50/20) |

The numbers given between parentheses after each copolymer indicate the percent by weight of the different monomers present in the copolymer.

The preparation of the following above-identified water-insoluble alkali-soluble copolymers has been described in GB-A No. 1,338,900, for instance co(methyl methacrylate/n-butyl acrylate/methacrylic acid) (30/35/35) can be prepared as described in Preparation 1 of said GB-A No. 1,338,900, co(methyl methacrylate/ethyl acrylate/methacrylic acid) (37/37/26) as described in Preparation 2, co(methyl methacrylate/2-ethylhexyl acrylate/methacrylic acid) (30/30/40) as described in Preparation 3, co(n-butyl methacrylate/ethyl acrylate/methacrylic acid) (2/78/20) as described in Preparation 4, co(methyl methacrylate/n-butyl acrylate/methacrylic acid) (2/68/30) as described in Preparation 5, co(ethyl methacrylate/n-butyl acrylate/methacrylic acid) (3/67/30) as described in Preparation 6, and co(methyl methacrylate/methyl acrylate/acrylic acid) (1/79/20) as described in Preparation 7.

The preparation of the other above-identified water-insoluble alkali-soluble copolymers can be derived easily by those skilled in the art from the preparation examples described in GB-A No. 1,338,900.

According to a preferred embodiment of the present invention the water-insoluble alkali-soluble copolymer binder of said antihalation layer essentially consists of a copolymer of 50% by weight of methyl methacrylate, 33.5% by weight of ethyl acrylate, and 16.5% by weight of methacrylic acid or of a copolymer of 30% by weight of isobutyl methacrylate, 50% by weight of n-butyl acrylate, and 20% by weight of acrylic acid.

The antihalation layer may in addition to carbon black and the water-insoluble alkali-soluble copolymer binder comprise additional ingredients such as i.a. compounds counteracting the formation of repellency spots or comets, sizing agents, waxes, surface-active agents e.g. of the type described in U.S. Pat. Nos. 2,600,831, 3,026,202, and 3,663,229, in BE-A No. 742,680, and in EP-A No. 0 015 592, and spacing agents such as those described in U.S. Pat. No. 4,614,708 and in Research Disclosure 25,111 (Mar. 1985), page 140.

The thickness of the antihalation layer is not critical, though a thickness of 0.5 to 3 μm is customary. The thickness of the layer and the amount of carbon black are preferably adjusted so that the resulting layer has an optical density of 0.5 to 1.5.

The hydrophobic transparent polyester film support of the photographic element according to the present invention preferably is a polyalkylene terephthalate film support, in particular a polyethylene terephthalate film support.

For the production of the polyethylene terephthalate film support of the photographic element according to the present invention the polyethylene terephthalate is extruded in the melt and quenched immediately on a cooling cylinder to form an amorphous film. The amorphous film is stretched monoaxially e.g. longitudinally or transversely, the stretching being performed at 80° to 90° C. to form a crystalline film having its dimension increased by 3 to 5 times. Subsequently, the monoaxially stretched film is coated with said poly-N-vinyl pyrrolidone subbing layer, the subbing layer obtained is dried, and the resulting subbed film support is stretched in a direction perpendicular to that of the first stretching operation, the dimension in this perpendicular direction increasing by 3 to 5 times as well. Finally, the film is heat-set at approximately 220° C. for a few seconds while being kept under tension in both directions. The subbed side of the polyethylene terephthalate film support is coated with a composition forming the alkali-soluble carbon black antihalation layer, whereas the other side can be coated with at least one layer for forming a light-sensitive silver halide element.

Prior to being coated with the aqueous solution for forming the subbing layer the surface of the hydrophobic transparent polyester film can be pretreated according to known techniques. For instance, the surface of the polyester film can be subjected to an electrical treatment with a high voltage corona.

The photographic element according to the present invention can be of any type using a removable alkali-soluble antihalation layer. Especially colour photographic motion picture projection film elements, which are multilayer colour print film elements intended for making colour release prints, advantageously comprise a polyester film support, a subbing layer, and an antihalation layer according to the present invention.

According to a preferential embodiment the present invention provides a colour photographic motion picture projection film element comprising a transparent polyester film support coated in succession with a subbing layer and an antihalation layer according to the invention and coated on the other side in succession with a blue-sensitive silver halide emulsion layer comprising a yellow-forming coupler, a red-sensitized silver halide emulsion layer comprising a cyan-forming coupler, an intermediate layer, a green-sensitized silver halide emulsion layer comprising a magenta-forming coupler, and an antistress layer.

Gelatin is used customarily as water-permeable hydrophilic colloid for the antistress layer. However, other water-permeable hydrophilic film-forming colloids can be used for that purpose e.g. proteins other than gelatin, cellulose derivatives e.g. hydroxyethyl cellulose and carboxymethyl cellulose, alginic acid and derivatives thereof, gum arabic, polyvinyl alcohol, poly-N-vinyl pyrrolidone and even mixtures of these.

When gelatin is used as hydrophilic colloid for the antistress layer, the aqueous coating composition for forming said layer usually comprises 2 to 20% by weight of gelatin, preferably 5% by weight of gelatin.

The coating composition for forming the antistress layer advantageously comprises a dispersion of at least one oil-former, the dispersed oil-former not including any dissolved ingredient whatsoever.

Oil-formers that can be employed successfully in producing such dispersion are tricresyl phosphate and 1-methoxy-2-propyl myristate.

The average size and distribution of the dispersed oil-former particles can be controlled by preparing the dispersion of the oil-former as follows.

A batch of 1 kg comprising 10% by weight of oil-former, 5% by weight of gelatin, and 1% by weight of emulsifying agent is made by first dissolving tricresyl phosphate or 1-methoxy-2-propyl myristate in e.g. 5 parts of ethyl acetate, dispersing the resulting solution in aqueous gelatin comprising at least one emulsifying agent, homogenizing the dispersion, and finally removing the ethyl acetate by evaporation.

The emulsifying agent is preferably a mixture of two emulsifying agents, the HLB-index of which mixture is as close as possible to that needed for the oil-former to be dispersed.

As is customary in relation to surface-active agents and emulsifying agents, the acronym HLB is used herein as an abbreviation of "Hydrophile-Lipophile Balance" and the term "HLB-index" denotes the numerical classification of an emulsifying agent according to the size and strength of mutually counteractive hydrophilic and lipophilic groups in the molecule as described in e.g. "Journal of Physical Chemistry" Vol. 76, No 14, (1972).

Suitable emulsifying agents for use in dispersing the oil-former can be chosen from i.a.:

MARLON A-396 (trade mark), which is a dodecyl-benzene sodium sulphonate sold by Chemische Werke Hüls AG., D-4370 Marl 1, Postfach 1320, Federal Republic of Germany, and designated hereinafter with the acronym EM-1, SPAN 40 (trade mark), which is an ester of monoanhydrosorbitol and palmitic acid sold by Atlas Chemical Industries N.V., Belgium, and designated hereinafter with the acronym EM-2, SPAN 85 (trade mark), which is a trioleate of monoanhydrosorbitol sold by Atlas Chemical Industries N.V., Belgium, and designated hereinafter with the acronym EM-3, FC126 (trade mark), which is perfluorocaprylic acid ammonium salt sold by 3M, St. Paul, Minn. 55101, U.S.A., and designated hereinafter with the acronym EM-4, TWEEN 61 (trade mark), which is a polyoxyethylene ester of monoanhydrosorbitol and stearic acid, sold by Atlas Chemical Industries N.V., Belgium, and designated hereinafter with the acronym EM-5, MERSOLAT H (trade mark), which is a sodium pentadecane sulphonate sold by Bayer A. G., Leverkusen, Federal Republic of Germany, and designated hereinafter with the acronym EM-6.

Preferred combinations of two of the above-mentioned emulsifying agents are the following, a preferred ratio by weight being given between parentheses after each combination:

EM-1 and EM-2 (30:70)
EM-1 and EM-3 (40:60)
EM-4 and EM-5 (50:50)

Thanks to the presence of two of the above-mentioned emulsifying agents fine-grained dispersions of tricresyl phosphate or of 1-methoxy-2-propyl myristate can be made, which dispersions have a very high stability.

The following examples illustrate the present invention.

EXAMPLE 1

A film support according to the present invention was made as follows.

A substantially amorphous polyethylene terephthalate film having a thickness of approximately 1.2 mm was formed by extrusion of molten polyethylene terephthalate at about 280° C. on a quenching drum and was chilled to about 75° C. The film was then stretched in the longitudinal direction over a differential speed roll stretching device to 3.5 times its initial length at a temperature of 84° C.

The following subbing layer composition was applied to the thus stretched film at a ratio of 1 l per 130 m2:

| | |
|---|---|
| demineralized water | 900 ml |
| isopropanol | 100 ml |
| poly-N-vinyl pyrrolidone | 5 g |
| surfactant | 5 ml |

The poly-N-vinyl pyrrolidone used in the above subbing layer composition is the above-specified LUVIS- KOL K-30 (trade mark) having a molecular weight of 40,000.

The surfactant used in the above subbing layer composition is a 87% aqueous solution of 2-(N,N-dimethyl-N-n-hexadecyl-ammonium)-acetic acid betain.

The resulting layer was dried in a hot airstream.

The subbed film was stretched transversely in a tenter frame to 3.5 times its original width at a temperature of approximately 80° C. The film was then conducted into an extension of the tenter frame, where it was heat-set while being kept under tension at a temperature of 200° C. for about 10 s.

The dry stretched poly-N-vinyl pyrrolidone subbing layer had a weight of 11 mg per m2.

The adhesion of the poly-N-vinyl pyrrolidone subbing layer to the polyethylene terephthalate film support was tested by pressing a pressure-sensitive adhesive tape to the dry subbing layer and then tearing the tape off at an acute angle. The subbing layer was left undamaged.

The poly-N-vinyl pyrrolidone subbing layer coated on a polyethylene terephthalate film support as described above was covered with an alkali-soluble carbon black antihalation layer from the following composition:

| | |
|---|---|
| demineralized water | 718 ml |
| methanol | 100 ml |
| aqueous dispersion of co(methyl methacrylate/ethyl acrylate/methacrylic acid) (50/33.5/16.5% by weight) comprising 25 g of solids per 100 ml | 82 ml |
| 20% aqueous dispersion of carbon black | 43 ml |
| 40% polyethylene latex | 16.5 ml |
| 1N ammonium hydroxide | 37 ml |
| dispersion of polymer beads | 2.6 ml |
| surfactant | 2 ml |

The carbon black used in the above antihalation layer composition is sold by Degussa AG., D-6000 Frankfurt/M., Postfach 11, Federal Republic of Germany, under the name DERUSSOL C (trade mark).

The polyethylene used in the above antihalation layer composition is sold by BASF AG, D-6700 Ludwigshafen/Rhein, Federal Republic of Germany, under the name PERAPRET PE-40 (trade mark).

The polymer beads used in the above antihalation layer are polymethyl methacrylate beads stabilized with a graft copolymer of methyl methacrylate and co(-styrene/maleic acid monosodium salt) and prepared as described in Preparation 1 of U.S. Pat. No. 4,614,708 or they are co(methyl methacrylate/stearyl methacrylate) (2–5% by weight of stearyl methacrylate) beads stabilized with a graft copolymer of methyl methacrylate and stearyl methacrylate on co(styrene/monosodium maleinate) and prepared according to the method described in the above-mentioned U.S. Pat. No. 4,614,708. The above amount of beads having an average particle size of 2 μm was taken from a dispersion in a mixture of water and ethanol (44% by weight of ethanol) comprising 20 g of beads per 100 ml.

The surfactant used in the above antihalation layer composition was taken from a solution of 10 g of GAFAC RM 710, sold by GAF CORP., 140W. 51st St., New York, N.Y. 10020, U.S.A., in 100 ml of methanol.

The antihalation layer composition was coated at a ratio of 1 l per 35 m2 and the resulting layer had a thickness of 1 μm and an optical density of 1.0.

The adhesion of the antihalation layer to the poly-N-vinyl pyrrolidone subbing layer was tested by pressing again a pressure-sensitive adhesive tape to the antihalation layer and then tearing the tape off at an acute angle. The antihalation layer was left undamaged.

EXAMPLE 2

A transparent polyethylene terephthalate film support carrying on its rear side a poly-N-vinyl pyrrolidone subbing layer and an alkali-soluble carbon black antihalation layer (prepared as described in Example 1 hereinbefore) was coated on its front side with layers needed for forming a colour photographic motion picture projection film element viz. in the given order a blue-sensitive gelatin silver halide emulsion layer comprising a yellow-forming coupler, an intermediate gelatin layer, a red-sensitized gelatin silver halide emulsion layer comprising a cyan-forming coupler, an intermediate gelatin layer, a green-sensitized gelatin silver halide emulsion layer comprising a magenta-forming coupler, and an antistress layer. The resulting film was cut into the format of motion picture film.

The motion picture film was exposed in a camera and then fed for 15 s through an ARRI C 8 processing device marketed by Arnold & Richter, Postfach 40 01 49, D-8000, Munich, Federal Republic of Germany. The film first passed through a unit comprising an alkaline prebath at 27° C., said prebath having the following composition:

| | |
|---|---|
| demineralized water | 1 l |
| tetrasodium salt of ethylenediamine tetraacetic acid | 2 g |
| sodium sulphate | 100 g |
| sodium tetraborate | 25 g |
| sodium hydroxide | 0.8 g |
| (pH-value: 9.30 ± 0.15) | |

The antihalation layer swelled in the alkaline prebath, but did not start loosening from the film support. Next, the film was conveyed at a speed of 50 m/min into the rinsing unit equipped in the order given with a sprayer and a rotating brush turning at a speed of 80 m per min. The brush rotated in a sense opposite to that of the moving film. The sprayer almost entirely eliminated the swollen antihalation layer from the support. Any remaining pieces of the antihalation layer were removed completely and quickly by means of the rotating brush.

The film, having lost its antihalation layer, was fed through the development zone at a speed of 50 m/min, where it was developed, rinsed, and fixed as usually.

The developed film showed no residual hue attributable to the former presence of the antihalation layer.

EXAMPLE 3

Comparison Film support A1

A subbing layer having the composition described in Example 4 of U.S. Pat. No. 4,132,552 was coated on a longitudinally stretched polyethylene terephthalate film support and stretched transversely as described in Example 1 of said U.S. Pat. No. 4,132,552. The dry subbing layer was covered with an alkali-soluble carbon black antihalation layer as described in Example 1 of the present application.

Comparison Film support A2

A subbing layer having the composition described in Example 4 of U.S. Pat. No. 4,132,552, except for the fact that the low viscous polyvinyl alcohol was replaced as hydrophilic polymer by an equivalent amount of poly-N-vinyl pyrrolidone having a molecular weight of 40,000 (the above-specified LUVISKOL K-30), was coated on a longitudinally stretched polyethylene terephthalate film support and stretched transversely as described in Example 1 of said U.S. Pat. No. 4,132,552. The dry subbing layer was covered with an alkali-soluble carbon black antihalation layer as described in Example 1 of the present application.

Film supports B to E according to the present invention

Film supports B to E (according to the present invention) comprising a polyethylene terephthalate film support, a poly-N-vinyl pyrrolidone subbing layer, and an alkali-soluble carbon black antihalation layer were made as described in Example 1 of the present application. The only difference between the Film supports B to E related to the nature of the poly-N-vinyl pyrrolidone type used in the subbing layer. These different poly-N-vinyl pyrrolidone types are specified in Table 1 hereinafter.

In Table 1 "PNVP" stands for poly-N-vinyl pyrrolidone, "mol. wt." stands for molecular weight, and "AH-layer" stands for antihalation layer.

The viscosity values given in Table 1 are expressed in mPa s. Each value was obtained by measuring the viscosity of a solution (at 20° C.) of the poly-N-vinyl pyrrolidone in a solvent mixture of water and isopropanol in a ratio by volume of 90:10, the amount of poly-N-vinyl pyrrolidone being chosen such that after application of the poly-N-vinyl pyrrolidone solution to a monoaxially stretched polyester support, drying, and subsequent transverse stretching, the thickness of the resulting dry stretched subbing layer was equivalent to a weight of 11 mg per m2.

The results of adhesion tests are listed in Table 1. The adhesion of the antihalation layer to the subbing layer of all Film supports A1, A2, and B to E was tested by pressing a pressure-sensitive adhesive tape to the antihalation layer and then tearing the tape off at an acute angle. The tearing off was carried out immediately after the pressure-sensitive adhesive tape had been pressed to the antihalation layer. The condition of the Film supports A1, A2, and B to E after the tearing off of the tape was evaluated visually. A value of 0 was attributed in case no visual damage had been done to the antihalation layer, a value of 1 when 25% of the surface of the antihalation layer had been damaged, 2 for 50% damage, 3 for 75% damage, and 4 for 100% damage.

Table 1 also shows results that provide a measure for the removability of the alkali-soluble carbon black antihalation layer. These results are in fact density values, which were obtained as follows. Each of the Film supports A1, A2, and B to E was fed in 15 s through an above-mentioned ARRI C 8 processing device comprising in the prebath unit an alkaline bath (27° C.) having the same composition as the alkaline prebath described in Example 2 of the present application. Next, each Film support was conveyed at a speed of 50 m/min into the rinsing unit, in which the swollen antihalation layer was eliminated almost entirely from the support by means of a spray jet. No use was made of the rotating brush to assist in removing the antihalation layer. The density of each Film support was then measured in a MACBETH TD 904 Densitometer through a red filter. For an exact appreciation of the results listed in Table 1 hereinafter one should take into account that the density of a naked polyethylene terephthalate film support averages 0.03–0.04.

TABLE 1

| Film support | PNVP having mol. wt of | Viscosity of PNVP solution | Adhesion of AH-layer | Removability of AH-layer |
|---|---|---|---|---|
| A1(comparison) | 40,000 | | 4 | 0.11 |
| A2(comparison) | 40,000 | | 4 | 0.10 |
| B | 10,000 | 1.73 mPa s | 2 | 0.05 |
| C | 40,000 | 1.87 mPa s | 0 | 0.04 |
| D | 160,000 | 2.16 mPa s | 0 | 0.04 |
| E | 700,000 | 3.56 mPa s | 0 | 0.04 |

These results show that the adhesion of the antihalation layer to a poly-N-vinyl pyrrolidone subbing layer according to the present invention is stronger than that of an antihalation layer on a known subbing layer comprising a maximum of 5% by weight of polyvinyl alcohol or poly-N-vinyl pyrrolidone hydrophilic colloid. The adhesion results obtained according to the present invention are particularly good when the subbing layer essentially consists of poly-N-vinyl pyrrolidone having a molecular weight of 40,000 to 700,000.

The values obtained for removability (expressed in density resulting from any remaining antihalation layer) show that the antihalation layer of a film support according to the present invention can be removed far more easily by spraying with water upon treatment in aqueous alkaline medium than that of the known film supports. It is especially striking that when the subbing layer of the film supports according to the present invention essentially consists of poly-N-vinyl pyrrolidone having a molecular weight of 40,000 to 700,000, the density is reduced to 0.04. After deduction of the inherent density of the polyethylene terephthalate film (0.03–0.04) the density approaches 0 or is 0, thus proving that almost no traces or no traces at all of the antihalation layer are left after rinsing with a spray jet and without making use of rubbing means such as rotating brushes. In contrast, the density measured on the comparison film supports revealed partially remaining antihalation layer.

EXAMPLE 4

Comparative tests were made with 4 Film supports F to I comprising a polyethylene terephthalate film support, a poly-N-vinyl pyrrolidone subbing layer (molecular weight of the poly-N-vinyl pyrrolidone: 40,000) applied before the secodn stretching, and an alkali-soluble carbon black antihalation layer, all as described in Example 1 of the present application. The only difference between these 4 Film supports F to I concerned the thickness of the dry stretched subbing layer.

In Table 2 hereinafter the values of thickness (expressed in weight per m2) of the dry stretched subbing layer, the results of an adhesion test, and the values obtained for removability of the antihalation layer are given. The values of adhesion and removability were obtained by proceeding exactly as described in the above Example 3.

To prove that it is of utmost importance to apply the poly-N-vinyl pyrrolidone subbing layer between both stretching operations and not after them, Table 2 also comprises the results obtained with Film supports J and K prepared as described hereinafter and comprising a poly-N-vinyl pyrrolidone subbing layer applied after bi-directional stretching.

Film support J was prepared as follows: A polyethylene terephthalate film was made and stretched longitudinally as described in Example 1. Next, the film was transversely stretched to 3.5 times its original width at approximately 80° C. and heat-set while being kept under tension at 200° C. for about 10 s. The subbing layer composition described in Example 1 was coated on the bi-directionally stretched film support so as to form a poly-N-vinyl pyrrolidone subbing layer having a thickness of 11 mg per m2 (film support J).

Alternatively, Film support K was prepared as follows: The same subbing layer composition as that of film support J was coated on a same bi-directionally stretched film support so as to form a poly-N-vinyl pyrrolidone subbing layer having a thickness of 60 mg per m2 (film support K).

In Table 2 "PNVP-layer" stands for poly-N-vinyl pyrrolidone subbing layer.

TABLE 2

| Film support | PNVP-layer applied | Thickness in mg/m2 | Adhesion of AH-layer | Removability of AH-layer |
|---|---|---|---|---|
| F | before 2nd stretching | 11 | 0 | 0.04 |
| G | before 2nd stretching | 60 | 0 | 0.04 |
| H | before 2nd stretching | 200 | 0 | 0.04 |
| I | before 2nd stretching | 500 | 2 | 0.05 |
| J | after 2nd stretching | 11 | 4 | 0.10 |
| K | after 2nd stretching | 60 | 4 | 0.09 |

These results show that the adhesion of the antihalation layer to a poly-N-vinyl pyrrolidone subbing layer according to the present invention was excellent when the weight of the poly-N-vinyl pyrrolidone subbing layer applied before the second stretching and measured after said second stretching was 11 to 200 mg per m2. When the thickness was increased to as high as 500 mg per m2, the adhesion revealed to be less effective. The adhesion was very bad when the poly-N-vinyl pyrrolidone subbing layer was applied after both stretching operations, thus proving that the special procedure, according to which the poly-N-vinyl pyrrolidone subbing layer is coated between both stretching operations, has to be followed necessarily to realize the excellent adhesion of the antihalation layer to the poly-N-vinyl pyrrolidone subbing layer in accordance with the present invention.

The values obtained for removability (expressed in density) show that the antihalation layer of a film support according to the present invention can be removed very easily and integrally after treatment in aqueous alkaline medium by merely rinsing with water by means of a spray jet. In contrast, the removability of the antihalation layer coated on a poly-N-vinyl pyrrolidone subbing layer applied after both stretching operations was clearly unsatisfactory.

EXAMPLE 5

A comparison Film support L was made exactly as described for comparison Film support A in the above Example 3. The comparison Film support L was cut in 2 pieces called Sample L1 and Sample L2 hereinafter.

A Film support M comprising a polyethylene terephthalate film support, a poly-N-vinyl pyrrolidone subbing layer, and an alkali-soluble carbon black antihalation layer according to the present invention was made as described in Example 1 of the present application. Film support M was also cut in 2 pieces called Sample M1 and Sample M2 hereinafter.

The adhesion of the antihalation layer to the subbing layer of the Film supports L1, L2, M1, and M2 was tested as described in the foregoing examples. In the case of the Film supports L1 and M1 the tearing off was carried out immediately after the pressure-sensitive adhesive tape had been pressed thereon. In the case of the Film supports L2 and M2 the tearing off was carried out 24 h after the pressure-sensitive adhesive tape had been pressed thereon. The results of the adhesion tests are given in the following Table 3.

TABLE 3

| Film support | Tearing off of tape after | Adhesion of AH-layer |
|---|---|---|
| L1 | 0 h | 2 |
| L2 | 24 h | 3 |
| M1 | 0 h | 0 |
| M2 | 24 h | 0 |

These results show that the adhesion of the antihalation layer on a poly-N-vinyl pyrrolidone subbing layer according to the present invention remains excellent even after prolonged contact with tape pressed thereon. In contrast the adhesion of the antihalation layer on a known subbing layer, which is already insufficient from the beginning is even worsen after prolonged contact with tape.

EXAMPLE 6

Film support N consisting of a transparent polyethylene terephthalate film support carrying on its rear side a poly-N-vinyl pyrrolidone subbing layer and an alkali-soluble carbon black antihalation layer prepared as described in Example 1 and comprising a 25% aqueous dispersion of co(methyl methacrylate/ethyl acrylate/-methacrylic acid) (50/33.5/16.5% by weight) as copolymer binder was compared as to the adhesion and the removability of the antihalation layer with Film support O, which was analogous to Film support N with the only difference that the copolymer binder had been replaced by an equivalent amount of a 25% aqueous dispersion of co(isobutyl methacrylate/n-butyl acrylate/acrylic acid) (30/50/20% by weight) and with Film support P, which was also analogous to Film support N with the only difference that the copolymer binder had been replaced by an equivalent amount of a 25% aqueous dispersion of co(ethyl methacrylate/n-butyl acrylate/methacrylic acid) (3/67/30% by weight).

In all three Film supports N, O, and P the thickness of the dry stretched subbing layer was 11 mg per m2.

Table 4 gives the results of an adhesion test and the values obtained for removability of the antihalation layer. The values of adhesion and removability were obtained by proceeding exactly as described in the above Example 3.

TABLE 4

| Film Support | Adhesion of AH-layer | Removability of AH-layer |
|---|---|---|
| N | 0 | 0.05 |
| O | 0 | 0.05 |
| P | 0 | 0.06 |

These results show that the adhesion of the antihalation layer comprising a water-insoluble alkali-soluble copolymer as identified above to a poly-N-vinyl pyrrolidone subbing layer was excellent.

The values obtained for removability (expressed in density) show that the antihalation layer of both film supports N and O according to the present invention can be removed very easily and integrally after treatment in aqueous alkaline medium by merely rinsing with water by means of a spray jet. The removability of the antihalation layer of film support P was fairly good.

We claim:

1. Photographic element comprising a dimensionally stable hydrophobic transparent biaxially stretched polyester film support, at least one light-sensitive silver halide emulsion layer, and at the side of said support opposite to that of said light-sensitive silver halide emulsion layer or layers, in the order given:

a layer of a water-soluble polymer binder essentially consisting of poly-N-vinyl pyrrolidone, and an antihalation layer comprising carbon black dispersed in a water-insoluble alkali-soluble copolymer binder essentially consisting of a copolymer of 1 to 65% by weight of a $C_1$–$C_4$ alkyl methacrylate, 10 to 79% by weight of a $C_1$–$C_8$ alkyl acrylate, and 10 to 50% by weight of acrylic acid and/or methacrylic acid.

2. A photographic element according to claim 1, wherein said water-insoluble alkali-soluble copolymer binder essentially consists of a copolymer of 50% by weight of methyl methacrylate, 33.5% by weight of ethyl acrylate, and 16.5% by weight of methacrylic acid or of a copolymer of 30% by weight of isobutyl methacrylate, 50% by weight of n-butyl acrylate, and 20% by weight of acrylic acid.

3. A photographic element according to claim 1, wherein said poly-N-vinyl pyrrolidone has a molecular weight of approximately 40,000 to 700,000.

4. A photographic element according to claim 1, wherein said dry stretched subbing layer comprises 10 to 250 mg of poly-N-vinyl pyrrolidone per m2.

5. A photographic element according to claim 1, wherein said polyester film support is a polyethylene terephthalate film support.

6. A photographic element according to claim 1, wherein said element is a colour photographic motion picture projection film element comprising, on the side of said support opposite to that of said subbing layer and said antihalation layer, in succession, a blue-sensitive silver halide emulsion layer comprising a yellow-forming coupler, a red-sensitized silver halide emulsion layer comprising a cyan-forming coupler, an intermediate layer, a green-sensitized silver halide emulsion layer comprising a magenta-forming coupler, and an antistress layer.

7. A photographic element according to claim 1, wherein said water-insoluble alkali-soluble copolymer binder is present in said antihalation layer in the form of an aqueous dispersion or latex.

* * * * *